US008555935B2

(12) United States Patent
Gustafsson

(10) Patent No.: US 8,555,935 B2
(45) Date of Patent: Oct. 15, 2013

(54) SYSTEM AND METHOD FOR FILLING OF CONTAINERS OF COLLAPSIBLE TYPE

(75) Inventor: Per Gustafsson, Bjärred (SE)

(73) Assignee: Ecolean AB, Helsingborg (SE)

( * ) Notice: Subject to any disclaimer, the term of this patent is extended or adjusted under 35 U.S.C. 154(b) by 398 days.

(21) Appl. No.: 13/002,126

(22) PCT Filed: Jun. 30, 2009

(86) PCT No.: PCT/SE2009/050839

§ 371 (c)(1),
(2), (4) Date: Mar. 17, 2011

(87) PCT Pub. No.: WO2010/002345

PCT Pub. Date: Jan. 7, 2010

(65) Prior Publication Data

US 2011/0162321 A1 Jul. 7, 2011

(30) Foreign Application Priority Data

Jul. 2, 2008 (SE) ..... 0801566

(51) Int. Cl.
*B65B 43/42* (2006.01)
*B65B 25/04* (2006.01)

(52) U.S. Cl.
CPC ..... *B65B 25/04* (2013.01)
USPC ..... 141/166; 141/10; 141/114; 141/315; 53/284.7

(58) Field of Classification Search
USPC ..... 141/10, 114, 166, 313–316; 53/248.7, 53/384.1, 570–573
See application file for complete search history.

(56) References Cited

U.S. PATENT DOCUMENTS

| | | | | |
|---|---|---|---|---|
| 2,703,671 | A * | 3/1955 | Kindseth | 141/75 |
| 2,715,004 | A * | 8/1955 | Fox | 248/101 |
| 2,768,655 | A * | 10/1956 | Bergeron | 141/65 |
| 3,112,777 | A * | 12/1963 | Lohse | 141/80 |
| 3,949,536 | A * | 4/1976 | Chevalier | 53/570 |
| 4,318,431 | A * | 3/1982 | Evans | 141/90 |
| 4,411,296 | A * | 10/1983 | Durant | 141/98 |
| 8,186,392 | B2 * | 5/2012 | Gustafsson | 141/114 |

FOREIGN PATENT DOCUMENTS

| | | |
|---|---|---|
| SE | 528 731 C2 | 2/2007 |
| WO | 2005/030597 A1 | 4/2005 |
| WO | 2007/091943 A1 | 8/2007 |

OTHER PUBLICATIONS

International Search Report: PCT/SE2009/050839.

* cited by examiner

*Primary Examiner* — Timothy L Maust
(74) *Attorney, Agent, or Firm* — Ladas & Parry LLP

(57) ABSTRACT

A system for filling a package of the collapsible type with a product in the form of a powder or liquid having a package, which has a chamber defined by flexible walls, and an arrangement for filling a package of the collapsible type with a product in the form of a powder or liquid.

12 Claims, 4 Drawing Sheets

SYSTEM AND METHOD FOR FILLING OF CONTAINERS OF COLLAPSIBLE TYPE

TECHNICAL FIELD

The present invention relates to a system and a method for filling a package of the collapsible type with a product in the form of a powder or liquid, and more particularly to such a system and corresponding method, which system comprises a package of the collapsible type. The system comprises an arrangement having a filling tube with an end portion which is made of a stiff material and which, in order to transfer said product to the chamber, is insertable into a filling channel of the package, which filling channel has an inner circumference, and a clamping element which is designed to grip the end portion and the filling channel when said end portion is inserted into said filling channel, so as to create a seal between the end portion and the filling channel.

BACKGROUND ART

Many different types of packages to be filled with products in the form of liquid or powder are currently available.

One type of package is collapsible and comprises two side walls and a bottom wall, which walls are interconnected along a connecting portion in order to form a chamber whose volume is dependent on the relative position of the flexible walls.

Before being filled, this type of package can be in a flat and sealed state. This makes it possible to sterilize the chamber of the package at the time of manufacture and, with maintained sterility, to distribute the package to a filling plant, such as a dairy. A package of the above-described type is known from WO2005/030597.

WO 2007/091943 describes an arrangement for filling packages of the abovementioned type. Said arrangement comprises a filling tube with an end portion and a clamping element. The filling tube, which is made of a stiff material, can be inserted into a filling channel of the package for the purpose of transferring a product to the package chamber via said filling tube. The clamping element is designed to grip the end portion and the filling channel when said end portion is inserted into said filling channel, so as to create a seal between the end portion and the filling channel.

In the filling machine described above, the end portion has a peripheral surface which is principally formed by two convexly curved central portions directed away from each other, which can be likened to a boat shape. This shape is optimal for creating as large a filling area as possible given a minimal closing-together of two opposite side edges of the filling channel. The minimal closing-together of said side edges permits control of the packages during the filling operation.

To permit a reliable and reproducible insertion of the end portion of the filling tube into the filling channels of the packages that are to be filled, a predetermined minimal clearance is provided between the end portion of the filling tube and the filling channel of the package. In some applications, it is necessary for this predetermined minimal clearance to be quite large, which may be the case when the package is moved to the filling tube at great speed and/or along a nonlinear path of movement. To create a relatively large clearance of this kind, the dimensions of the filling tube can be reduced, which entails a reduced rate of flow through the filling tube, which in turn entails slower filling of the package.

The above-described arrangement for filling packages of the collapsible type can also entail a risk of leakage during the filling operation as a result of folds forming when the clamping elements grip the filling channel and the end portion of the filling tube that has been inserted into same.

There is therefore a need for a filling arrangement which permits efficient and rationalized filling of packages of the collapsible type, even when a relatively large clearance is needed between the filling channel and the inserted end portion of the filling tube, and which eliminates or in any case reduces the risk of leakage.

SUMMARY OF THE INVENTION

In view of the above, it is an object of the present invention to make available a system and a method that permit efficient and rationalized filling of packages of the collapsible type.

It is also an object to make available a system and a method that permit efficient filling of packages of the collapsible type even when a relatively large clearance is present between a filling channel of the package and the end portion of the filling tube.

A further object is to make available a system and a method for filling packages of the collapsible type where the risk of leakage as a result of the formation of folds has been eliminated.

To achieve at least one of these objects, and also other objects that will become evident from the following description, the present invention provides a system for filling a package of the collapsible type, according to claim 1, and a corresponding method according to claim 12. Embodiments of the system are set out in claims 2-11, which are dependent on claim 1, and embodiments of the method are set out in claims 13-15, which are dependent on claim 12.

More specifically, according to the present invention, a system is provided for filling a package of the collapsible type with a product in the form of a powder or liquid. The system comprises a package of the collapsible type, which has a chamber defined by flexible walls, and an arrangement for filling said package with a product in the form of a powder or liquid. Moreover, the arrangement comprises a filling tube with an end portion which is made of a stiff material and which has an outer circumference and which, in order to transfer said product to the chamber, is insertable into a filling channel of the package, which filling channel has an inner circumference, and a clamping element which is designed to grip the end portion and the filling channel when said end portion is inserted into said filling channel, so as to create a seal between the end portion and the filling channel. The system is characterized in that the difference between the inner circumference of the filling channel and the outer circumference of the end portion is less than or equal to four times a wall thickness of the package walls, such that the ability of the filling channel to form folds when gripped by means of the clamping element is eliminated.

A system that permits efficient and rationalized filling of packages is thus provided. The system according to the invention eliminates the risk of leakage resulting from the formation of folds when the clamping element grips the filling channel and the end portion of the filling tube inserted therein. By virtue of the fact that the end portion of the filling tube is made of a stiff material, a seal is obtained between said filling channel and the end portion when the clamping element grips the end portion and the filling channel. The seal is reliable since the circumference of the filling channel, in relation to the outer circumference of the end portion, is arranged such that the ability of the filling channel to form folds when gripped by means of the clamping element is eliminated. More specifically, the system is designed in such a way that the difference between the inner circumference of the filling channel and the outer circumference of the end portion is less than or equal to four times a wall thickness of the package walls. It has been found that if the difference is four times the wall thickness or less, the excess material in the side walls defining the filling channel is not sufficient to allow folds to form during gripping by the clamping element.

The system according to the invention thus ensures that a package of the collapsible type can be filled in a short time without the risk of the product escaping from the package as a result of the formation of folds in the filling channel.

The end portion can have a substantially square cross section with a first pair of diagonally opposite corners which are rounded, and with a second pair of diagonally opposite corners which converge in a concave shape. This configuration of said end portion, in combination with relatively large opening of the filling channel by means of substantial separation of those parts of the side walls that define said filling channel, makes it possible to create a relatively large filling area, while at the same time a relatively large clearance can be obtained between the end portion of the filling tube and the filling channel. As a result, this shape of the end portion of the filling tube permits efficient and rapid filling of packages of the collapsible type, even when a relatively large clearance is needed between said end portion and said filling channel.

The filling channel can have an inner circumference in the range of 40-120 mm.

The outer circumference of the end portion can be greater than said inner circumference of the filling channel of the package. When the inserted end portion has an outer circumference greater than said inner circumference of the filling channel of the package, a tensile stress is created, in the side walls of the package that define the filling channel, when the clamping element grips the end portion and round the filling channel.

The outer circumference of the end portion can exceed the inner circumference of the filling channel of the package by 0.1-2 mm.

Moreover, in a plane including a first axis and a second axis arranged at right angles thereto, the end portion can have a width extending along said second axis, and the filling channel, in the same plane, can have a length extending along the second axis, and the difference between said length and said width can exceed 2 mm. In this way, it is possible to ensure that the end portion of the filling tube is inserted into the filling channel of the package with a high degree of reliability and, at the same time, at high speed and/or along a nonlinear path of movement.

The clamping element can have a grip surface which has a shape matching an outer peripheral surface of said end portion.

The clamping element can also comprise a pair of jaws designed to grip the end portion of the filling tube. The jaws define said grip surface.

The pair of jaws can have a dividing plane which, during filling of a package, is parallel to a pair of opposite side walls of the package. In the unfilled state of the package prior to filling, the package is flat with parallel opposite side walls. At the time of filling, the dividing plane of the pair of jaws is thus parallel to said side walls in this state. It will be appreciated that when the filling operation has been initiated and the package is being filled with a product, the side walls will separate from each other and will no longer be parallel to each other or to said dividing plane.

According to one embodiment, the end portion can have a substantially square cross section with a first pair of diagonally opposite corners which are rounded, and with a second pair of diagonally opposite corners which converge in a concave shape, the clamping element can comprise a pair of jaws designed to grip the end portion of the filling tube, and the pair of jaws can have a dividing plane that is parallel to an imaginary connecting plane for the second pair of diagonally opposite corners. In this way, it is possible to create a clamping element which, when activated, creates a seal with a very high degree of reliability between the filling channel and the end portion of the filling tube.

Said clamping element can comprise elastic grip surfaces which are designed to grip said filling channel and said end portion. The sealing element can in this way be made to grip gently round the end portion and the filling channel while at the same time providing a reliable seal.

According to one embodiment, the filling tube can be stationary.

Moreover, according to the present invention, a method is provided for filling a package of the collapsible type with a product in the form of a powder or liquid, which package has a chamber defined by flexible walls, in which method a filling tube, with an end portion which is made of a stiff material and which has an outer circumference, is introduced into a filling channel that has an inner circumference, and the end portion and the filling channel are gripped by means of a clamping element so as to create a seal between the end portion and the filling channel, and the difference between the inner circumference of the filling channel and the outer circumference of the end portion is made to be less than or equal to four times a wall thickness of the package walls, such that the ability of the filling channel to form folds when gripped by means of the clamping element is eliminated.

An improved method is in this way provided for filling a package of the collapsible type with a product in the form of a powder or liquid.

By following the method according to the invention, a reliable seal is obtained between the end portion and the filling channel. This is by virtue of the fact that the circumference of the filling channel, in relation to the outer circumference of the end portion, is arranged such that the ability of the filling channel to form folds when gripped by means of the clamping element is eliminated. More specifically, the difference between the inner circumference of the filling channel and the outer circumference of the end portion is made such that it is less than or equal to four times a wall thickness of the package walls. It has been found that if the difference is made four times the wall thickness or less, the excess material in the side walls defining the filling channel is not sufficient to allow folds to form during gripping by the clamping element. The method according to the invention thus ensures that a reliable seal is obtained between the end portion of the filling tube and the filling channel of the package when the clamping element grips the end portion and the filling channel. Moreover, the method according to the invention permits rapid filling without the risk of the product escaping from the package during the filling operation. Moreover, the end portion of the filling tube can be inserted into the filling channel of the package at high speed and/or along a nonlinear path of movement.

According to one embodiment, the method according to the invention can involve transferring a product to the chamber of the package via the end portion inserted into said filling channel. This transfer can be done, for example, by opening a filling valve that can be located in an outlet of the end portion. The filling valve can of course also be arranged in another position in the filling tube or in a product line connected to the filling tube. In this way, the product flows out through the filling tube and onward into the chamber of the package.

During the filling operation, the chamber of the package expands in response to the incoming product, like a balloon that is being inflated.

The method according to the invention can also involve the use of a transport unit to move the package to a position where said filling tube is arranged.

According to a further embodiment of the method according to the invention, the filling tube can be stationary at said position. The package can be moved to said position along a curved transport path.

BRIEF DESCRIPTION OF THE DRAWINGS

Embodiments of the present invention will be described below by way of example and with reference to the accompanying drawings.

DESCRIPTION OF EMBODIMENTS

Figure 1:
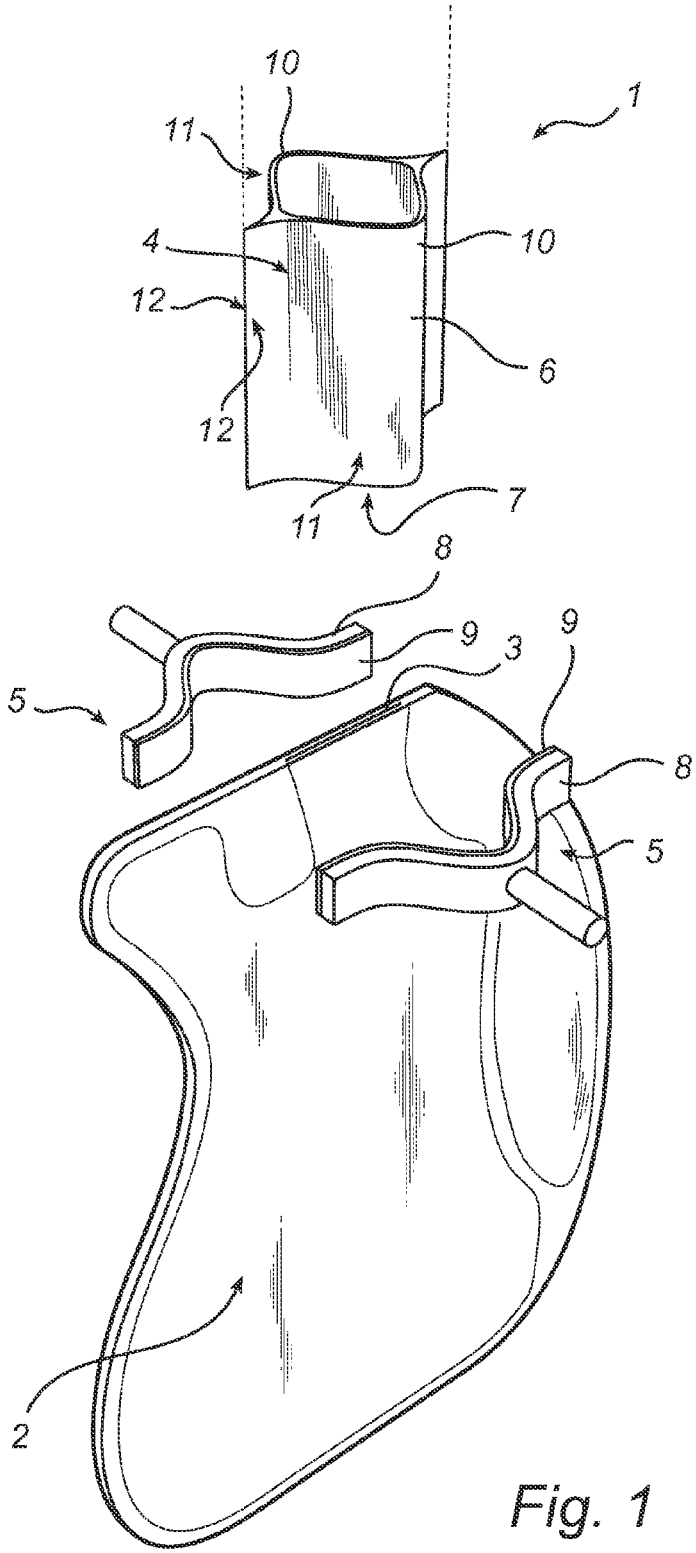
FIG. 1 is a schematic perspective view of an embodiment of a system according to the invention for filling a package of the collapsible type.

FIG. 1, to which reference is now made, shows an embodiment of a system according to the invention for filling a package 2 of the collapsible type. The system according to the invention also comprises, in addition to said packages 2, an arrangement 1 for filling the packages 2.

A package 2 of this type can, as is shown in the figure, have two opposite side walls and a bottom wall (not shown). The walls are interconnected along a connecting portion and define a chamber whose volume is dependent on the mutual position of the walls. A filling channel 3 of the package 2, which filling channel 3 can be defined by said side walls, places the chamber in communication with the environment. The filling channel 3 has an inner circumference C1, which can be in the range of 40-120 mm. The filling channel 3 can be sealed when the package is in the unfilled state, with the channel 3 being opened before filling. It can be opened by cutting, clipping or the like. It is thus possible, in a simple manner, to ensure that packages 2 are provided with sterile chambers at the time of production and can then be distributed, still in a sterile state, to the intended site, such as a dairy, for use in the system according to the invention.

The arrangement 1 comprises as main components a filling tube 4 and a clamping element 5. Other details of the arrangement 1 have been omitted for the sake of clarity.

The filling tube 4 is connected to a source (not shown) of the product that is to be transferred into the package 2, and it terminates in an end portion 6. The end portion 6 has an outlet opening 7. The end portion 6 has an outer circumference C2. The end portion 6 of the filling tube 4 is made of a stiff material, for example stainless steel.

In the embodiment shown, the clamping element 5 comprises a pair of jaws 8 which are designed to grip the end portion 6 of the filling tube 4. The jaws 8 can thus be moved toward and away from each other, and the package 2, which is flat in the unfilled state, is positioned such that its opposite side walls are parallel to the dividing plane of the pair of jaws 8. Each jaw 8 has an elastic grip surface 9. It will be appreciated that, during and after filling, said side walls no longer assume a mutually parallel position and thus no longer lie parallel to said dividing plane of the pair of jaws 8.

Figure 2:
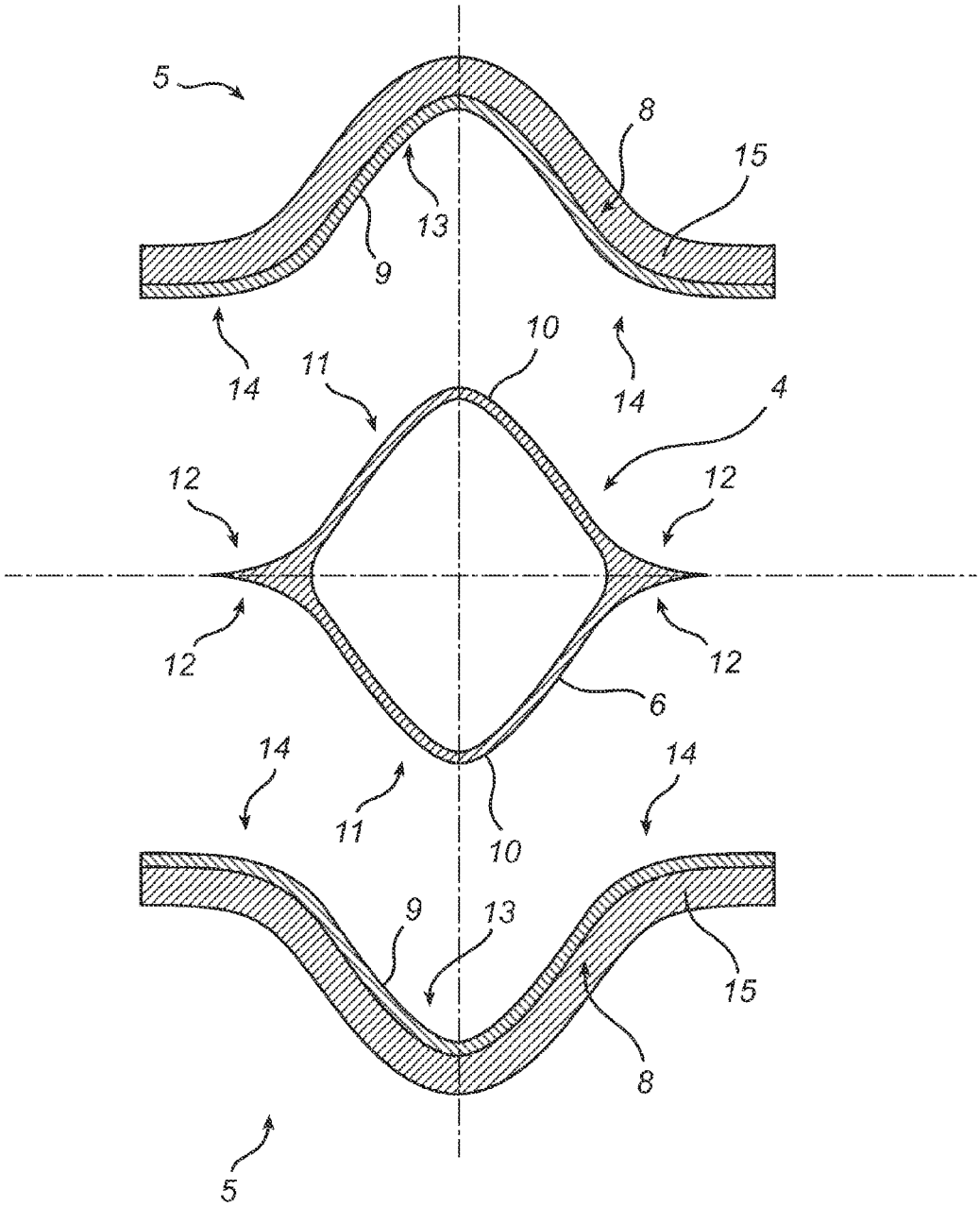
FIG. 2 is a schematic cross section of the system according to the invention, which cross section is taken across the end portion, seen in the longitudinal direction of the filling tube.

FIG. 2, to which reference is now made, shows a schematic cross section through the system according to the invention shown in FIG. 1, which cross section is taken across the end portion 6, seen in the longitudinal direction of the filling tube 4. As is evident from the figure, the end portion 6 of the filling tube 4 has a substantially square cross section in which two of the diagonally opposite corners are rounded and the two other diagonally opposite corners converge in a concave shape. Said end portion can also be said to comprise two opposite subsidiary surfaces 10, of which a central portion 11 of a respective subsidiary surface 10 is composed of one of the two opposite rounded corners and of linear sections adjoining the latter. Arranged on each side of the respective central portion 11, there is a concavely curved side portion 12. The two opposite subsidiary surfaces 10 are arranged with the rounded central portions 11 directed away from each other, and the side portions 12 of the subsidiary surfaces 10 on each side of the central portions 11 adjoin each other in a converging manner and thus form said concavely converging, diagonally opposite corners.

The inner circumference C1 of the filling channel 3 is arranged, in relation to the outer circumference C2 of the end portion 6, in such a way that the ability of the filling channel 3 to form folds when gripped by means of the clamping element 5 is eliminated. This condition is fulfilled when the difference between the circumference C1 of the filling channel 3 and the outer circumference C2 of the end portion 6 is less than or equal to four times the wall thickness of the package 2. A typical wall thickness is 150 μm.

The above condition is specifically fulfilled when the outer circumference C2 of the end portion 6 of the filling tube 4 is greater than the inner circumference C1 of the filling channel 3 of the package 2. More particularly, said outer circumference C2 can exceed said inner circumference C1 by 0.1-2 mm.

In the embodiment shown, the grip surface 9 of each jaw 8 has a shape matching the subsidiary surface 10 of the periphery of the end portion 6. Each grip surface 9 thus has a rounded central portion 13 which matches the rounded central portion 11 of the respective subsidiary surface 10. Each grip surface 9 also has two opposite and rounded edge portions 14. These rounded edge portions 14 match the shape of the concave side portions 12 of each subsidiary surface 10.

It will be appreciated, however, that the grip surfaces 9 do not need to match the shape of the subsidiary surfaces 10 of the periphery. The important point is that the grip surfaces 9 are placed against the filling channel 3 of the package 2 and cooperate with said subsidiary surfaces 10 when the clamping element 5 grips the filling channel 3 and the end portion 6 of the filling tube 4 inserted therein, so as to exert a clamping and sealing pressure about the circumference C1.

In particular, beads can be arranged in said edge portions (not shown), which beads generate an increased bearing pressure around the diagonally opposite and concavely converging corners, which can reduce the risk of leakage.

As has already been stated, the jaws 8, which can be moved toward and away from each other, have a dividing plane parallel to the opposite side walls of the package 2. This dividing plane is also parallel to an imaginary connecting plane between said concavely converging opposite corners of said end portion 6.

Each grip surface 9 of each jaw 8 is supported by a structure 15.

It will be appreciated that the end portion 6 of the filling tube 4 does not necessarily need to have a cross section with the above-described shape. It is thus sufficient for the end portion 6 to have a cross section whose outer circumference C2 is adapted, in relation to the inner circumference of the filling channel 3, in such a way as to fulfil the above-described difference and thus ensure that the ability of the filling channel 3 to form folds when gripped by means of the clamping element 5 is eliminated.

It will also be appreciated that it is not necessary for the whole of the end portion 6 of the filling tube 4 to have a cross section whose outer circumference C2 is adapted, in relation to the inner circumference of the filling channel 3, in such a way that the ability of the filling channel 3 to form folds when gripped by means of the clamping element 5 is eliminated. It is thus sufficient for the end portion 6 to have one area with a cross section having such an outer circumference C2, which area corresponds to that part of the end portion 6 gripped by the pair of jaws 8.

Before a package 2 is filled, it is opened by cutting, clipping or the like, as a result of which the chamber of the package 2 is brought into communication with the environment via said filling channel 3. The filling channel 3 is also opened up by separation of opposite parts of the side walls, which parts define said filling channel 3 of the opened package 2, as a result of which the filling channel 3 forms a tube-shaped connection between the chamber of the package 2 and the environment. The separation of those parts of the side walls defining the filling channel can be done with the aid of a pair of gripping elements, for example suction cups, which can be brought into engagement with the opposite parts of the side walls of the package 2 that define the filling channel.

By ensuring that the separation of said parts that define the filling channel is sufficiently great, it is possible to provide a dimensionally stable opening of said filling channel.

When the filling channel has been opened up, the clamping elements can be arranged so as to grip the package on both sides of the opened filling channel. In this way, it is possible to lock the filling channel in the opened and dimensionally stable state while the gripping elements, such as suction cups, are able to disengage from said parts defining the filling channel.

The filling channel can be opened up before or at the time when the package has been arranged at a filling station.

The filling station can have a vertically movable filling tube and, after the package has been arranged at the filling station, the end portion of the filling tube is lowered and inserted into the opened filling channel of the package.

Alternatively, the filling station can have a stationary filling tube. The package can be transferred to the filling station, for example, with the aid of a transport unit (not shown) for moving packages along a curved transport path, so as to dock the package to the filling tube of the filling station, such that the opened filling channel of the package is engaged over the end portion of the filling tube. The transport unit can be designed to move an opened package 2 from a pick-up position along a curved, for example semicircular, transport path to a delivery position. In this way, a package 2 is transported from a station where the filling channel 3 of the package 2 has been opened up, in accordance with the above, to a subsequent station where filling of the package 2 is carried out.

Figure 3:
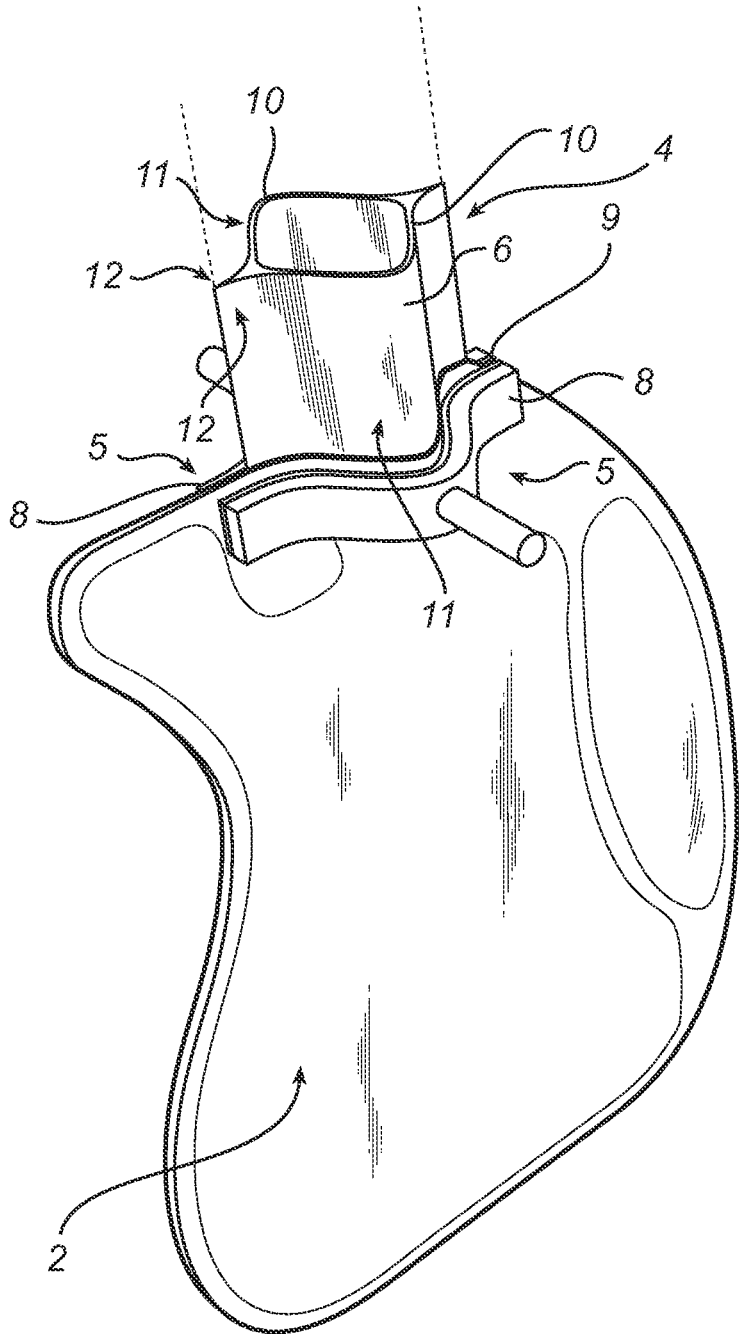
FIG. 3 is a schematic perspective view illustrating the system from FIG. 1 during use for filling a package of the collapsible type.

When the package 2 has been arranged at the filling station and the end portion of the filling tube has been inserted into the filling channel of the package by means of a relative movement between the filling tube and the package, the clamping element 5 is activated such that its jaws 8 grip the end portion 6 and thus also the filling channel 3, as is shown in FIG. 3. By virtue of the fact that the end portion 6 of the filling tube 4 is made of a stiff material, a seal is obtained between said filling channel 3 and the end portion 6 when the clamping element 5 grips the end portion 6 and the filling channel 3. The seal is reliable, since the inner circumference C1 of the filling channel 3 is arranged, in relation to the outer circumference C2 of the end portion 6, in such a way that the ability of the filling channel 3 to form folds when gripped by means of the clamping element 5 is eliminated. In the specific case when the outer circumference C2 of the end portion 6 of the filling tube 4 is greater than the inner circumference C1 of the filling channel 3 of the package 2, a tensile stress is created in the flexible material forming the side walls of the filling channel 3 when the clamping element 5 grips the end portion 6 and the filling channel 3. By virtue of the fact that the grip surfaces 9 of the pair of jaws 8 are elastic, those parts of the side walls of the package 2 that define said filling channel 3 are not damaged. It will be appreciated that the structures 15 of the jaws 8 can be designed to ensure that the grip surfaces 9 generate a clamping pressure in the direction of moving together of the jaws 8 when the latter are moved together. This can be done, for example, by having the grip surfaces 9 project slightly outward from said structures 15 (not shown).

By virtue of the fact that the inner circumference C1 of the filling channel 3 is arranged, in relation to the outer circumference C2 of the end portion 6, in such a way that the ability of the filling channel 3 to form folds when gripped by means of the clamping element 5 is eliminated, the formation of folds is counteracted, in those parts of the side walls of the package 2 that define said filling channel 3, when the clamping elements grip the filling channel 3 and the end portion 6 of the filling tube 4. Since the formation of folds is counteracted, the risk of leakage as a result of the formation of folds is also reduced.

When the clamping element 5 has been activated such that its jaws 8 grip the filling channel 3 and the end portion 6 of the filling tube 4, the package 2 can be filled with a product in a suitable manner. This can be done, for example, by opening a filling valve (not shown), which may be located in the outlet 7 of the end portion 6. The filling valve can of course also be arranged in another position in the filling tube 4 or in a product line connected to the filling tube 4.

The end portion 6 can have a narrowing shape in order to make it easier to insert into the filling channel 3 of the package 2.

By opening said filling valve, the product flows out through the filling tube 4 and onward into the chamber in the package 2. During the filling operation, the chamber in the package 2 will expand in response to the product flowing into it, like a balloon that is being inflated. The seal is created by the clamping element 5 gripping the filling channel 3 and the end portion 6 of the filling tube 4.

Figure 4:
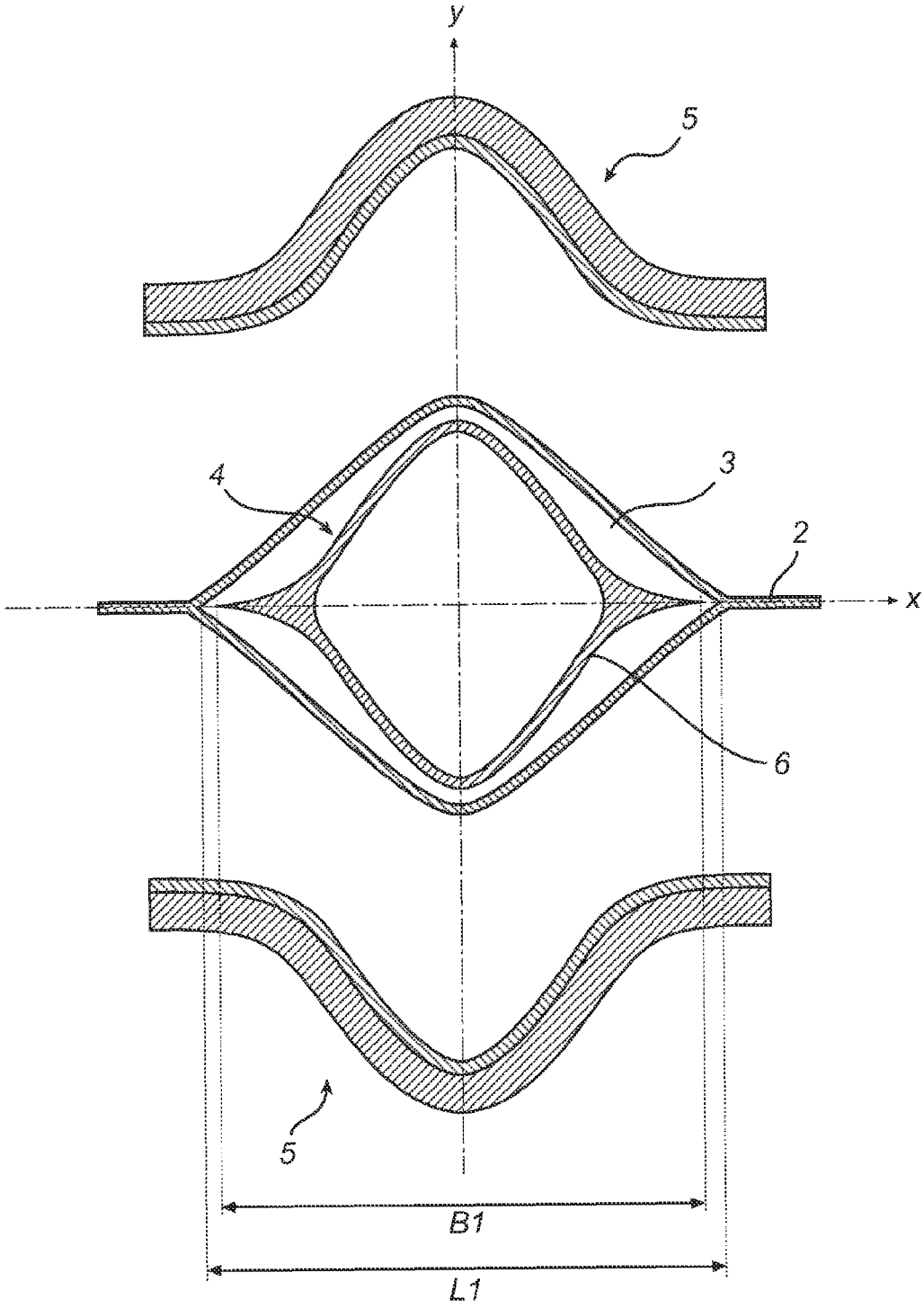
FIG. 4 shows a schematic cross section taken across the filling tube when the end portion thereof has been inserted into the filling channel of the package, but before the clamping element has been activated for gripping the end portion and said filling channel.

FIG. 4 shows a schematic cross section taken across the filling tube 4 when its end portion 6 has been inserted into the filling channel 3 of the package 2, but before the clamping element 5 has been activated to grip the end portion 6 and said filling channel 3.

As has already been mentioned, the end portion 6 of the filling tube 4 can have a cross section basically in the shape of a square, but in which two of the opposite corners are rounded and in which the two other opposite corners converge in a concave shape. As has already been mentioned, the inner circumference C1 of the filling channel 3 is arranged, in relation to the outer circumference C2 of the end portion 6, in such a way that the ability of the filling channel 3 to form folds when gripped by means of the clamping element 5 is eliminated. This condition is fulfilled when the difference between the circumference C1 of the filling channel 3 and the outer circumference C2 of the end portion 6 is less than or equal to four times the wall thickness of the package 2.

The above condition is specifically fulfilled when the outer circumference C2 of the end portion 6 of the filling tube 4 is greater than the inner circumference C1 of the filling channel 3 of the package 2. More particularly, the outer circumference C2 of the end portion 6 can exceed said inner circumference C1 by 0.1-2 mm. Since the inner circumference C1 of the filling channel 3 is arranged, in relation to the outer circumference C2 of the end portion 6, in such a way that the ability of the filling channel 3 to form folds when gripped by means of the clamping element 5 is eliminated, and since the end portion 6 of the filling tube 4 is made of a stiff material, the formation of folds is counteracted, in those parts of the side walls of the package 2 that define said filling channel 3, when the clamping elements grip the filling channel 3 and the end portion 6 of the filling tube 4. This means that a very good seal is obtained between said filling channel 3 and the end portion 6 when the clamping element 5 grips the end portion 6 and the filling channel 3.

In the case where the package is moved along a curved path to a stationary filling tube at a filling station, for docking the package onto the filling tube by inserting the end portion into the filling channel, a minimum clearance is required between the end portion of the filling tube and the filling channel of the package. This is needed to ensure a reliable and reproducible insertion of said end portion into said filling channel. This can be illustrated in the following way. The end portion 6, in a plane including a first axis Y and a second axis X arranged at right angles thereto, has a width B1 extending along said second axis X, and the filling channel 3, in the same plane, has a length L1 extending along the second axis X, the difference between said length L1 and said width B1 exceeding 2 mm.

It will be appreciated that the present invention is not limited to the embodiment shown.

To prevent product from depositing on the walls of the filling channel 3 upon removal of the end portion 6 of the filling tube 4, the latter can also be dimensioned relative to the filling channel 3 in such a way that the end portion 6 can be removed without contact with the walls of said filling channel 3.

To prevent product from depositing on the inside of the walls of the filling tube 4 at the two opposite and concavely converging corners of the side portions 12, the inner wall of the filling tube, at these two opposite and concavely converging corners, can also have a concavely rounded shape, as is also shown in the figures.

To minimize dripping and also the depositing of product on the walls of the filling channel, said end elements can have a liquid-repelling surface.

Several modifications and variations are therefore possible, for which reason the present invention is defined exclusively by the accompanying claims.

The invention claimed is:

1. A system for filling a package of the collapsible type with a product in the form of a powder or liquid, said system comprising:

a package of the collapsible type, which has a chamber defined by flexible walls, and an arrangement for filling said package with a product in the form of a powder or liquid, which arrangement comprises a filling tube with an end portion which is made of a stiff material and which has an outer circumference (C2) and which, in order to transfer said product to the chamber, is insertable into a filling channel of the package which filling channel has an inner circumference (C1), and a clamping element which is designed to grip the end portion and the filling channel when said end portion is inserted into said filling channel when said end portion is inserted into said filling channel, so as to create a seal between the end portion and the filling channel, wherein the difference between the inner circumference (C1) of the filling channel and the outer circumference (C2) of the end portion is less than or equal to four times a wall thickness of the package walls, such that the ability of the filling channel to form folds when gripped by means of the clamping element is eliminated.

2. The system according to claim 1, in which said end portion has a substantially square cross section with a first pair of diagonally opposite corners which are rounded, and with a second pair of diagonally opposite corners which converge in a concave shape.

3. The system according to claim 1, in which said filling channel has an inner circumference (C1) in the range of 40-120 mm.

4. The system according to claim 1, in which the outer circumference (C2) of said end portion is greater than said inner circumference (C1) of the filling channel of the package.

5. The system according to claim 4, in which the outer circumference (C2) of the end portion exceeds the inner circumference (C1) of the filling channel of the package by 0.1-2 mm.

6. The system according to claim 1, in which the end portion, in a plane including a first axis (Y) and a second axis (X) arranged at right angles thereto, has a width (B1) extending along said second axis (X), and the filling channel, in the same plane, has a length (L1) extending along the second axis (X), the difference between said length (L1) and said width (B1) exceeding 2 mm.

7. The system according to claim 1 in which said clamping element has a grip surface which has a shape matching an outer peripheral surface of said end portion.

8. The system according to claim 1, in which the clamping element comprises a pair of jaws designed to grip the end portion of the filling tube.

9. The system according to claim 1, in which said end portion has a square cross section with a first pair of diagonally opposite corners which are rounded, and with a second pair of diagonally opposite corners which converge in a concave shape, the clamping element comprises a pair of jaws designed to grip the end portion of the filling tube, and the pair of jaws has a dividing plane that is parallel to an imaginary connecting plane for the second pair of diagonally opposite corners.

10. The system according to claim 8, in which said jaws have elastic grip surfaces.

11. The system according to claim 1, in which the filling tube, is stationary.

12. The system according to claim 9, in which said jaws have elastic grip surfaces.

* * * * *